United States Patent [19]

Abrams et al.

[11] 3,965,712

[45] June 29, 1976

[54] AQUEOUS BASE POST PICKLING AND COLD ROLLING FLUID

[75] Inventors: Ellis Abrams, Harleysville; Sidney Barber, Philadelphia, both of Pa.

[73] Assignee: E. F. Houghton and Company, Philadelphia, Pa.

[22] Filed: Oct. 22, 1975

[21] Appl. No.: 624,932

Related U.S. Application Data

[62] Division of Ser. No. 569,662, April 21, 1975, Pat. No. 3,933,661.

[52] U.S. Cl. ..... 72/42; 72/46

[51] Int. Cl.[2] ..... B21B 45/02

[58] Field of Search ..... 72/42, 46; 252/32.5, 252/33.4, 49.5, 51.5 A, 389 R

[56] References Cited

UNITED STATES PATENTS

| | | | |
|---|---|---|---|
| 3,359,202 | 12/1967 | Stambaugh | 252/33.4 |
| 3,442,805 | 5/1969 | Johnson | 252/49.5 |
| 3,676,344 | 7/1972 | Kuceski | 252/49.5 |
| 3,719,598 | 3/1973 | King | 252/33.4 |

*Primary Examiner*—C.W. Lanham
*Assistant Examiner*—E. M. Combs
*Attorney, Agent, or Firm*—Howson and Howson

[57] ABSTRACT

An aqueous base lubricant composition particularly useful as a post pickle and rolling fluid for steel comprising an aqueous dispersion of (1) a water miscible fluid which is the condensation product of from 1.5 to 2 moles of a dialkanol amine which is either diethanolamine or diisopropanolamine and one mole of a monocarboxylic acid containing 10–20 carbon atoms, or glyceride thereof, and (2) an agent for reducing the viscosity of the aqueous composition which is either (a) an alkyl aryl sulfonate, (b) a monoalkyl ether of a lower alkylene glycol, (c) a lower glycol, or (d) a monoalkyl ether of a polyoxyalkylene glycol. The lubricant compositions may contain extreme pressure or antifriction additives as well as materials which enhance the rust and corrosion protection provided by said compositions.

5 Claims, No Drawings

AQUEOUS BASE POST PICKLING AND COLD ROLLING FLUID

This application is a division of our copending application Ser. No. 569,662, filed Apr. 21, 1975, now patent 3,933,661.

PRIOR PROCEDURES

In the production of cold rolled steel, hot ingots of steel are first rolled to produce a four to six inch thick slab, and thereafter the slab is reduced in thickness to produce a strip having a thickness of 0.075 to 0.250 inch. After the hot rolled strip is formed, it is introduced to a pickling bath containing sulfuric or hydrochloric acid to remove scale formed by oxidation during the hot rolling process.

After removal from the pickling bath the steel sheet is rinsed with water to remove the acid, air dried and coiled. In the prior procedures, a post pickling fluid has been applied to the surfaces of the sheet prior to coiling for the purpose of minimizing scratching during coiling and to lubricate the surfaces of the sheet in subsequent cold rolling operations.

The post pickling fluids used heretofore generally have been compounded oils which provide the sheet with a coating of oil. Such fluids generally have comprised mineral or fatty oil, rust inhibitors such as petroleum sulfonates, lubricating additives such as alkyl acid phosphates, and emulsifiers or dispersants.

These pickling fluids have suffered from a number of disadvantages. A particular problem has been one of disposal of the spent fluids for, by their inherent oily nature, such fluids have the potential for polluting rivers and streams. Such fluids are also known to drip from the coiled pickled strip, with the result that the work area is rendered dirty and unsafe by reason of oily deposits. A further problem is that of "mill refusal" or "gagging". More specifically, the oily nature of the fluid interferes with the mill rolls getting a "bite" on the strip to cause the strip to advance through the rolls during cold rolling. In order to overcome this particular problem kerosene has been added to the fluid to reduce lubricity. However, kerosene represents a distinct fire hazard in the cold rolling operation.

OBJECTS OF THE INVENTION

It is an object of this invention to provide an aqueous base post pickling fluid and lubricant for the cold rolling of steel, which composition is substantially nonstaining and noncorrosive to steel.

A particular object of this invention is an aqueous base post pickling fluid and rolling lubricant which substantially overcomes the above-described pollution and fire hazards presented by the oily compositions heretofore used in post pickling and cold rolling operations.

A still further object is to provide an aqueous base post pickling fluid which has a substantially reduced tendency to drip from the coiled pickled steel strip, thereby simplifying the maintaining of clean, safe work areas.

Still another object of this invention is the provision of an aqueous base rolling fluid which improves the surface life of the work rolls, provides for a clean rolling operation, and makes possible the production of clean steel strip which does not exhibit the defect commonly referred to as "carbon edge".

These and other objects of this invention will become apparent from the following detailed description of the invention and appended claims.

DESCRIPTION OF THE INVENTION

According to this invention there is provided a novel aqueous base post pickling fluid and cold rolling lubricant containing in addition to water, two essential constituents in given proportions, namely, (1) a water miscible fluid which is the condensation product of an aliphatic monocarboxylic acid containing 10–20 carbon atoms, or a glyceride thereof, and a dialkanol amine selected from the group consisting of diethanolamine and diisopropanolamine, the mole ratio of dialkanol amine to carboxylic acid being from about 1.5 to 2 to one, and an agent for reducing the viscosity of the aqueous base fluid which is either (a) an alkyl aryl sulfonate, (b) a mono alkyl ether of a lower alkylene glycol, (c) a lower glycol, or (d) a mono alkyl ether of a polyoxyalkylene glycol, and mixtures of such agents. The aqueous base fluids may contain extreme pressure or anti-friction additives, as well as materials which enhance the rust and corrosion protection provided by such fluids.

The two essential constituents identified above can be combined to form a concentrate comprising about 50 to 92% acidamine condensate, and about 8–50% of the viscosity reducing agent. Preferably the concentrate comprises 50–80% of the condensate and 20–50% of viscosity reducing agent. The concentrate can then be added to water. In the case of a post pickling fluid, the concentrate may comprise about 15–50% by weight, based on the total weight of the aqueous fluid.

In preparing a cold rolling fluid according to this invention, the concentrate may be combined with water so that the resulting aqueous base composition comprises about 0.5 to 2% by weight of the total composition, of the concentrate.

The aqueous base fluids of this invention are substantially "oil free" in that they do not contain any oily component, e.g. petroleum oil, fatty oil, etc. Thus, the novel fluid, after use, presents a much reduced pollution problem as compared to the prior oily fluids used for the same purpose.

In addition, when applied to sheet steel immediately following the pickling operation, at which time the steel is at a temperature of about 160° – 220°F., the water evaporates leaving the surfaces of the sheet coated with an adherent film which provides both corrosion resistance and lubricity to prevent scratching during coiling and uncoiling. The film also provides lubricity during the initial stages of cold reduction. Inasmuch as the film is adherent to the steel strip, it does not drip therefrom, an important factor in maintaining a clean safe work area.

The aqueous base fluids of this invention provide the sheet with a bright clean finish and there is an absence of a carbon edge.

As previously stated, the water-miscible fluid is a condensation product of an aliphatic monocarboxylic acid, or glyceride, and a dialkanol amine, in the proportions of substantially from 1.5 to 2.7 moles of the amine to one of the carboxylic acid. The monocarboxylic acids preferably are fatty acids having from 10 to 20 carbon atoms and glycerides of such acids. Examples of such fatty acids are stearic acid, palmitic acid, oleic acid, linoleic acid, lauric acid, myristic acid, coconut oil fatty acids, ricinoleic acid and the like, as well as the glycerides of such acids. Preferred carboxylic acids include refined tall oil fatty acids (predominantly a mixture of oleic and linoleic acids), and the glycerides commonly known as tallows and lard oils.

The aforementioned monocarboxylic acids are reacted with a dialkanol amine. Examples of such dialkanol amines are duethanol-, and diisopropanol-amine.

The condensates are prepared by reacting not substantially less than about 1.5 and preferably about 2 moles of the dialkanol amine with one mole of monocarboxylic acid. The condensation reaction takes place at temperatures above about 100°C. but below the temperature of decomposition of the resulting material. Where the monocarboxylic acid reactant is in the form of a glyceride, the aforesaid mole ratio of amine to acid refers to moles of acid in any such glyceride.

A particularly preferred condensate fluid for use in the products of the present invention comprises the condensation product of about 1.8 moles of diethanol amine and one mole (based on carboxylic acid content) of yellow grease (approximately 85% glyceride of a mixture of stearic, palmitic and oleic acids). Another preferred water-miscible condensate is the reaction product of diethanol amine and tall oil fatty acids in the abovespecified molar ratios of amine to fatty acid. Condensates of the type used in the lubricant compositions of the present invention and procedures for preparing them are described in detail in U.S. Pat. No. 2,089,212.

In the post pickle fluids and cold rolling lubricants of this invention it is believed that the above-described condensates, which should be liquid at ambient temperatures, function to provide the fluids with the necessary lubricity. In addition, to some degree they act as rust inhibitors for steel sheet.

Although the above-described condensates are miscible with water, it was found that when aqueous compositions containing such condensates are applied to the hot steel during the post pickling operation, the aqueous compositions undergo a substantial increase in viscosity with reduction in water content due to evaporation. Such increase in viscosity interferes with the uniform distribution of the condensate on the steel surface. steel The result is that upon evaporation of substantially all water there remains on the surface of the steel sheet islands of condensate separated by uncoated, and thus unprotected, areas. It was discovered that by including in the aqueous base lubricant compositions of this invention one or more viscosity reducing agents in specified amounts, the aforementioned problem of uneven and incomplete distribution of the condensate on the surface of the steel sheet can be overcome.

As indicated above, the viscosity reducing agents are of four chemical types, namely (a) alkyl aryl sulfonates, (b) mono alkyl ethers of lower alkylene glycols, (c) lower glycols, and (d) mono alkyl ethers of certain polyoxyalkylene glycols, as well as mixtures of such agents.

The alkyl arylene sulfonates, which are commonly referred to as "mahogany sulfonates" because of their characteristic color, are oil soluble and, when derived by sulfonation of a heavy petroleum distillate typically contain a single aromatic ring with a long aliphatic chain. Thus, such sulfonates can be represented by the general formula $$RSO_3X$$

in which R is an alkyl arylene (generally phenylene) containing from 20 to 30 carbon atoms, and X is sodium, potassium, ammonium or a primary, secondary or tertiary amine. The average molecular weight of such sulfonates produced from petroleum fractions ordinarily will be on the order of about 450–500. Methods for preparation of such sulfonates are well known. See Kirk-Othmer *Encyclopedia of Chemical Technology*, 2d., Volume 19, pages 296–297 (1969).

A preferred sulfonate is a sodium alkyl phenylene sulfonate having an average molecular weight of about 455–480 derived from petroleum.

In the aqueous base fluids of this invention the sulfonate provides the steel with some rust protection. In addition, the sulfonate provides some degree of lubricity, acts as a bodying agent for the composition and assists in solubilizing the non-aqueous constituents in the major constituent, water.

A second class of viscosity reducing agents is the mono alkyl ethers of lower alkylene glycols having the formula $$R'O(CH_2\underset{\underset{R''}{|}}{C}HO)_yOH$$

in which R′ is an alkyl group containing from 1 to 4 carbon atoms, R″ is hydrogen or methyl, and $y$ is an integer from 1 to 3. Typical of such ethers are the mono ethyl ether of ethylene glycol, and the mono butyl ether of propylene (R″ is $CH_3$) glycol, the latter being a preferred ether-type viscosity reducing agent.

The third class of viscosity reducing agents are the lower glycols selected from the group consisting of dipropylene glycol, tripropylene glycol, 1,5-pentane diol, 2-ethyl-1,3-hexane diol, and hexylene glycol (2-methyl-2,4-pentane diol).

The fourth category of viscosity reducing agents are the mono alkyl ethers of polyoxyalkylene glycols. These compounds, which contain both oxyethylene and oxy 1,2-propylene groups are also referred to as monohydroxy oxy ethylene oxy 1,2-propylene aliphatic monoethers in which the ethylene oxide and 1,2-propylene oxide are combined therein as oxyethylene and oxy 1,2-propylene groups. Ordinarily, in such compounds the oxyethylene and oxy 1,2-propylene are combined in a ratio which is at least one-third part of 1,2-propylene oxide for each part of ethylene oxide. Such compounds generally will have an average molecular weight of at least 500, of which at least 300 is attributable to the oxyethylene and oxy 1,2-propylene groups.

These ethers and processes for their production which involve reacting together an alcohol, e.g. butanol, ethylene oxide and 1,2-propylene oxide, are described in U.S. Pat. No. 2,425,755. The resulting product is a mixture of ethers, which mixture has certain physical properties and an average molecular weight. A preferred viscosity reducing agent of this type is a mixture of butyl monethers having an average molecular weight of about 850. In such ethers preferably there is a 1:1 ratio of 1,2-propylene oxide to ethylene oxide groups.

Although the desired viscosity reduction of the aqueous base lubricant compositions of this invention can be accomplished by the use of a compound selected from any one of the four above-described classes of compounds, various mixtures of compounds from different classes can also be used. A preferred combination of viscosity reducing agents is given in Example 3, below.

The compositions of this invention may also contain other additives such as agents which improve lubricity and fluidity, as well as others which enhance the corrosion resistance provided by such compositions.

Examples of agents for enhancing lubricity are alkyl acid phosphates of the general formula:

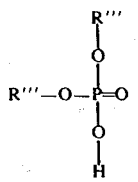

in which R''' is an alkyl group containing from 10 to 12 carbon atoms. A preferred phosphate of this type is lauryl acid phosphate.

In the lubricating compositions of this invention it is desirable that the acid phosphates be neutralized. Where an excess of amine is used in preparing the acid-amine condensates, such amine is available to effect such neutralization. However, neutralization can also be accomplished by adding various amines, such as diethanol amine, diisopropanol amine, and triethanol amine.

An additive which can be included to enhance the corrosion resistance provided by the novel lubricants is a petroleum oxidate.

These additional, and optional additives may comprise up to about 12%, by weight, of the concentrates or non-aqueous portion of the lubricants of this invention.

The concentrates can be prepared merely by mixing together at ambient temperatures the several constituents, all of which are liquids at such temperature. The aqueous base lubricants can then be prepared from the concentrates merely by combining them with an appropriate quantity of water, i.e. about 15–50% for post pickle fluids, and about 0.5 – 2% for rolling lubricants.

The following specific examples are merely representative of preferred embodiments of the invention and are by no means exhaustive. Rather, they are merely such as to teach those skilled in the art the manner in which the invention may be practiced.

Concentrates having the following formulations were prepared by combining the several constituents.

Example 1

| Constituent | Weight Per Cent |
|---|---|
| Sodium petroleum sulfonate* | 23.0 |
| Fatty Acid-amine condensate** | 69.5 |
| Mixture of decyl and lauryl acid phosphates | 7.5 |

*sodium alkyl phenylene sulfonate, average M.W. 455–480
**condensation product of diethanolamine and yellow grease, in the proportions of 1.8 mols of amine per mole of fatty acids in the grease Example 2

| Constituent | Weight Per Cent |
|---|---|
| Sodium petroleum sulfonate* | 21.4 |
| Fatty acid-amine condensate** | 64.1 |
| Mixture of decyl and lauryl phosphates | 7.2 |

Example 2-continued

| Constituent | Weight Per Cent |
|---|---|
| Triethanol amine | 7.3 |

*sodium alkyl phenylene sulfonate, average M.W. 455–480
**condensation product of 1.8 moles of diethanolamine and one mole of yellow grease Example 3

| Constituent | Weight Per Cent |
|---|---|
| Sodium petroleum sulfonate* | 10 |
| Fatty acid-amine condensate** | 53 |
| Butyl carbitol | 15 |
| Mono butyl ether of polyoxyalkylene glycol*** | 15 |
| Lauryl acid phosphate | 7 |

*sodium alkyl phenylene sulfonate, average M.W. 455–480
**condensation product of diethanolamine and yellow grease, in the proportion of 1.8 moles of amine for each mole of fatty acids in the grease
***mixture of monohydroxy oxyethylene oxy 1,2-propylene butyl monoethers, ave. M.W. 850, 1:1 ratio oxyethylene to oxy 1,2-propylene groups Example 4

The concentrates of Examples 1, 2 and 3 were diluted with water to provide several post pickling fluids containing 25%, 30% and 35% of concentrate. The several post pickling fluids were separately charged into the recirculating pickler upcoiler lubrication system of a sheet steel mill. Each fluid was flowed onto the freshly pickled surfaces of carbon sheet steel prior to a set of pinch rolls designed to level the fluid as well as advance the strip of steel into a loosely formed coil. Excess fluid was squeezed off the sides of the strip during passage through the pinch rolls.

The steel sheets or strips to which the post pickling fluids were applied had different thicknesses and widths. The width of some strips was only 20 inches whereas that of others was as much as 48 inch. Similarly, some sheets were relatively thin, e.g. 0.08 inch whereas others were as thick as 0.25 inch. The temperature of the steel strips at the time of application of the post pickling fluids was in the range of 140°–180°F.

The post pickling fluids of the Examples 1, 2 and 3 protected the freshly pickled sheets from rusting and from scratching and coil digs during coiling at the exit side of the pickle line in the upcoiler and during uncoiling in the coil box immediately prior to subsequent cold reduction. The post pickling fluids also serve as a lubricant at the No. 1 stand of the cold reduction mills where the stand merely uses a water wash.

Example 5

The concentrates of Examples, 1, 2 and 3 were diluted with water to provide aqueous base lubricants containing about 2% concentrate. Each such lubricant composition was treated for its lubricating properties in the cold rolling of steel using the following procedure.

A divided tank coolant reservoir having a capacity of 16,000 gallons, was charged with approximately 14,000 gallons of water. Twelve 55-gallon drums of a mixture consisting of 30 parts of the concentrate of Example 1 and 70 parts water were charged into this system. The resulting solution was recirculated over a standard design 3-stand, 4-high cold reduction mill. The recirculation was done with the use of transfer pumps which were an integral part of the reservoir system. Hot rolled steel which had previously been pickled and oiled were subsequently cold reduced using the solution mentioned above. The nature of the coating of the pickled sheet was either a standard petroleum oil/fatty oil blend or a mixture consisting of 30 parts of the concentrate of Example 1 and 70 parts water.

The coils of steel referred to in Example 4, above, were cold rolled. Of the large number of coils that were rolled, only two coils were rejected because of carbon edge.

Similar rolling tests were conducted in the same manner using concentrates of Examples 2 and 3 in place of that of Example 1. Results were the same.

It was determined that the aqueous lubricants of this invention effectively cool work roll surfaces, provide lubrication during the rolling (reduction) process, improve surface life of work rolls, aid in maintaining the shape of strip (sheet rolled) and cleanliness of rolling operation, and provide a strip of sufficient cleanliness at the exit side of the mill such that the defect known as carbon edge, just prevalent after cold reduced sheet has been annealed, is eliminated.

What is claimed is:

1. A process for producing steel sheet which comprises

A. applying to hot freshly pickled steel sheet an aqueous base post pickling fluid comprising 1. from about 85% to about 50%, by weight of water and from about 15% to about 50% of a concentrate comprising
   a. from about 50% to about 92%, by weight, of a water miscible fluid which is the condensation product of an aliphatic monocarboxylic acid containing from 10 to 20 carbon atoms, or glyceride thereof, and a dialkanolamine selected from the group consisting of diethanolamine and diisopropanolamine, the mole ratio of dialkanolamine to carboxylic acid being not less than about 1.5 to 1
   b. from about 8% to about 50% of an agent for reducing the viscosity of aqueous base lubricant compositions containing said concentrate, said viscosity reducing agent being selected from the group consisting of
      i. a sulfonate of the general formula $RSO_3X$ in which R is an alkyl arylene group containing from 20 to 30 carbon atoms and X is Na, K, $NH_4$ or an amino group ii. a mono alkyl ether of a lower alkylene glycol of the formula

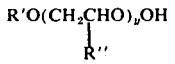

in which R′ is an alkyl group containing from 1 to 4 carbon atoms, R″ is H or $CH_3$, and *y* is an integer of from 1 to 3 iii. a glycol selected from the group consisting of dipropylene glycol, tripropylene glycol, 1,5-pentane diol, 2-ethyl-1,3-hexane diol, and hexylene glycol, iv. a monohydroxy oxyethylene oxy 1,2-propylene aliphatic monoether in which the ethylene oxide and 1,2-propylene oxide are combined therein as oxyethylene and oxy 1,2-propylene groups, said monoether having an average molecular weight of at least 300, and mixtures of said viscosity reducing agents, and B. subsequently subjecting said steel sheet to cold rolling in the presence of an aqueous base rolling lubricant comprising 1. from about 99.5% to about 98%, by weight, of water and
2. from about 0.5% to about 2% of said concentrate.

2. The process according to claim 1 in which said concentrate comprises (a) from about 50% to about 80% of said water miscible condensation product, and (b) from about 20% to about 50% of said viscosity reducing agent.

3. The process according to claim 1 in which said concentrate contains up to about 12% of a lubricity enhancing agent comprising a neutralized alkyl acid phosphate of the general formula

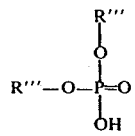

in which R‴ is an alkyl group containing from 10 to 12 carbon atoms.

4. The process according to claim 1 in which said concentrate comprises (a) about 53% of a water miscible fluid which is the condensation product of yellow grease and diethanolamine, the mole ratio of said amine to carboxylic acid of said grease being about 1.8 to 1, (b) as a viscosity reducing agent, the combination of about 10% of a sodium petroleum sulfonate having a molecular weight of about 455 to about 480, 15% of butyl carbitol and 15% of a mixture of monohydroxy oxyethylene oxy 1,2-propylene butyl monoethers having an average molecular weight of about 850 in which ethylene oxide and 1,2-propylene oxide are combined therein as oxyethylene and oxy 1,2-propylene groups in the ratio of one part of ethylene oxide for each part of 1,2-propylene oxide, and (c) about 6% lauryl acid phosphate, said percentages being by weight based on the total weight of said concentrate.

5. The process according to claim 4 in which said post pickling fluid comprises (a) about 70% water and (b) about 30% of said concentrate, and said rolling lubricant comprises (a) about 98.5% water and (b) about 1.5% of said concentrate.

* * * * *